United States Patent [19]

Masaki

[11] 4,403,212

[45] Sep. 6, 1983

[54] DIGITAL RADIO PAGING COMMUNICATION SYSTEM

[75] Inventor: Masaru Masaki, Tokyo, Japan

[73] Assignee: Nippon Electric Co., Ltd., Tokyo, Japan

[21] Appl. No.: 194,262

[22] Filed: Oct. 6, 1980

[30] Foreign Application Priority Data

Oct. 9, 1979 [JP] Japan ..... 54-129385

[51] Int. Cl.[3] ..... G08B 5/22; H04Q 1/30

[52] U.S. Cl. ..... 340/311.1; 340/825.44; 340/825.48; 179/2 EC; 455/38

[58] Field of Search ..... 340/825.44, 825.48, 340/825.36, 825.37, 825.47, 311.1, 825.45, 825.46, 825.5, 825.51; 455/31-38; 179/2 EC

[56] References Cited

U.S. PATENT DOCUMENTS 3,846,783 11/1974 Apsell et al. ..... 455/38

3,944,724 3/1976 Kilby et al. ..... 455/351

4,091,373 5/1978 Nakamura ..... 455/38

4,249,165 2/1981 Mori ..... 455/38

4,263,480 4/1981 Levine ..... 179/2 EC

*Primary Examiner*—John W. Caldwell, Sr.

*Assistant Examiner*—Donnie L. Crosland

*Attorney, Agent, or Firm*—Laff, Whitesel, Conte & Saret

[57] ABSTRACT

A paging communication receiver receives carrier waves modulated by a sequence of signals comprising a calling signal, a display information signal and a discriminating signal. The modulated carrier wave is demodulated to retrieve the calling signal, display information signal and discriminating signal. The calling signal is detected and decoded to provide a detection signal, when the discriminating signal represents a calling signal. The detection signal causes a decoding for displaying information when the discriminating signal is the one representing the display information signal.

9 Claims, 17 Drawing Figures

| | | | | | | | | | | |
|---|---|---|---|---|---|---|---|---|---|---|
| C1 | 1 | 1 | 1 | 0 | 1 | 1 | 0 | 1 | 0 | 0 |
| C2 | 0 | 1 | 1 | 1 | 0 | 1 | 1 | 0 | 1 | 0 |
| ≈ | ≈ | | | | | | | | | ≈ |
| C21 | 1 | 1 | 0 | 1 | 1 | 0 | 1 | 0 | 0 | 1 |
| C22 | 1 | 0 | 0 | 0 | 0 | 0 | 0 | 0 | 0 | 0 |
| ≈ | ≈ | | | | | | | | | ≈ |
| C30 | 0 | 0 | 0 | 0 | 0 | 0 | 0 | 0 | 1 | 0 |
| C31 | 0 | 0 | 0 | 0 | 0 | 0 | 0 | 0 | 0 | 1 |

DIGITAL RADIO PAGING COMMUNICATION SYSTEM

The present invention relates to a radio paging communication system in which a transmitter transmits a calling signal and display information signals to a plurality of receivers.

In a conventional communication system, the transmitter transmits a calling signal and display information signal. If the calling signal identifies a particular receiver, it emits an alert tone and may give display information signal on an optical display unit.

However, such a calling signal and display information signal are each fixed at a set number of bits. As a result, the conventional system has a disadvantage in that the display information signal of a fixed length has to be transmitted even when it has a smaller number of digits (for instance when only a calling signal has to be transmitted). Accordingly, the communication line cannot be efficiently utilized.

An objective of the present invention therefore is to provide a radio paging communication system wherein the transmitter transmits a discriminating signal immediately before transmitting each word. The discriminating signal is a binary word which indicates whether the word to be transmitted is a calling signal word or a display information word. The receiver can recognize this word discriminating signal and make an individual selection to receive the display information word in any desired number of words.

In accordance with the invention, a paging communication receiver receives a carrier wave which is modulated with a sequence of signals comprising a calling signal, a display information signal, and a discriminating signal, immediately preceding each of said calling signal and display information signal for indicating distinction between them. The modulated carrier wave is demodulated into said calling signal, display information signal and discriminating signal. The demodulated signal is decoded and the calling signal is detected to provide a detection signal, when said discriminating signal is the one representing the calling signal. Responsive to the detection signal the display information signal is decoded, when the discriminating signal is the one representing the display information signal. The decoded signal is then displayed.

Other advantages and features of the present invention will be more apparent from the detailed description hereunder taken in conjunction with the accompanying drawings, wherein.

Figures 1A, 1B, 1C, 2:
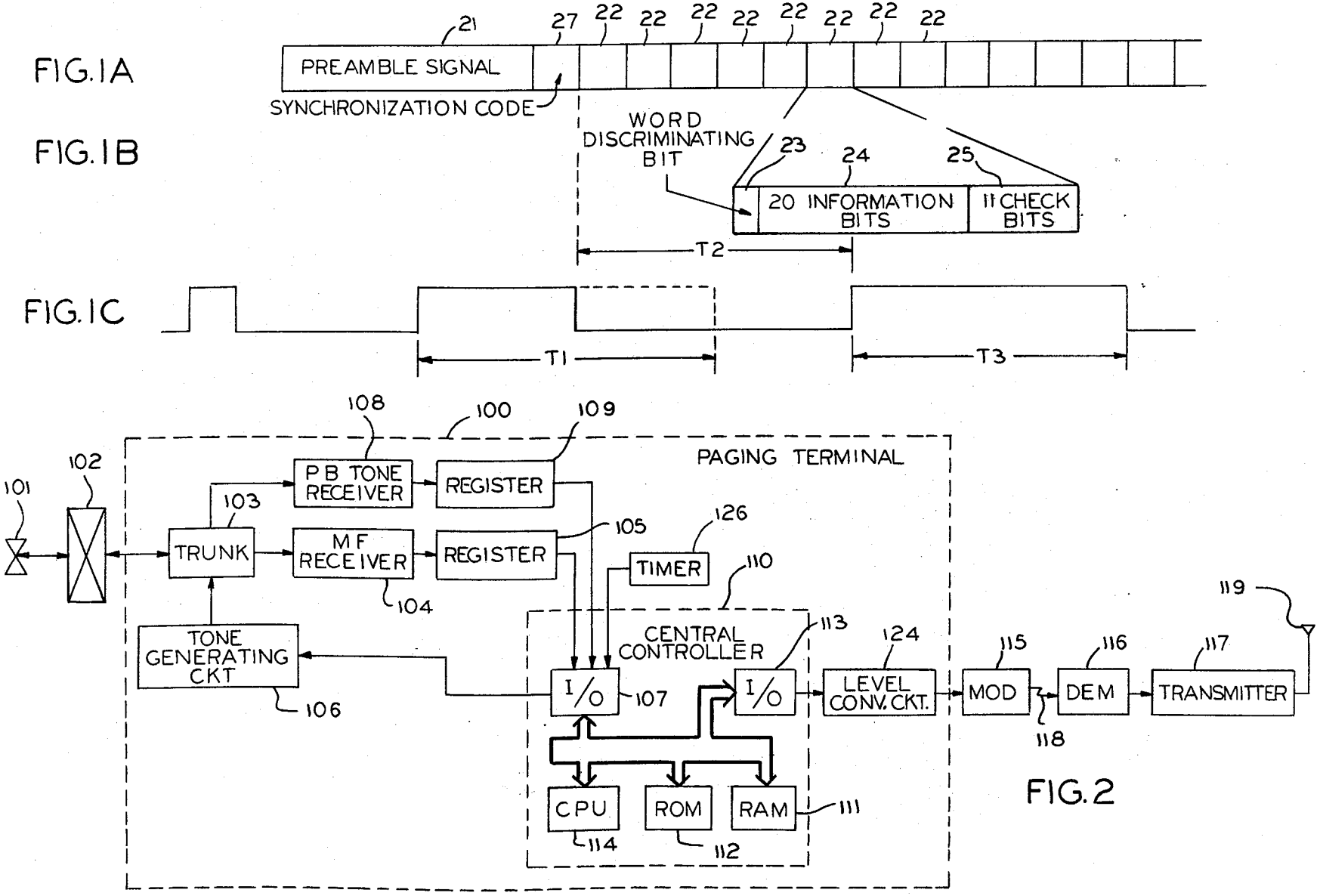
FIGS. 1A–1C show an example of a transmission signal.
FIG. 2 is a block diagram illustrating a base station (or a transmitter) of the present invention.

The transmission signal from a base station is shown in FIG. 1A, as consisting of a preamble signal 21, a sync signal 27 for word synchronization and the following binary words 22, each of which comprises 32 bits. Bose Chaudhuri Hocquenghem (BCH) codes and one even parity bit are used for the words (31, 21). Each of the words 22, as shown in FIG. 1B, has a first bit which serves as word discriminating bit 23, 20 information bits 24, and 11 check bits 25. If the word discriminating bit 23 is "0", the word is a calling signal word. Or, if the word discriminating bit 23 is "1", the word is a display information word. In a calling signal word, the calling number assigned to a receiver is conveyed by the use of 20 information bits. In a display information word, information for display is also conveyed by the use of the 20 information bits. In an embodiment of the present invention, 16-bit binary-coded decimal (BCD) signals are converted from four-digit decimal numbers of which each digit is assigned four bits, and the converted signals are conveyed as information bits.

Figure 4A:
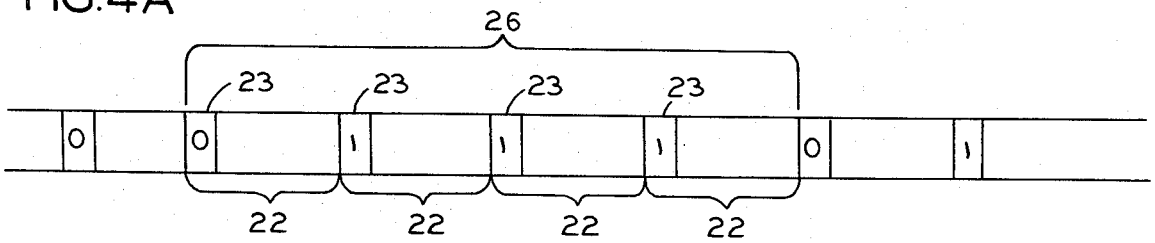
FIGS. 4A to 4D are the waveforms at the respective points A to D in FIG. 3.

Reference numeral 26 in FIG. 4A, represents a receiving signal for one subscriber, when there are three display information words. In the first word 22 of the signal, which is a calling signal word, the word discriminating bit 23 is "0". The word discriminating bits 23 of the second through fourth words, which are display information words, are "1". In this particular example, the number of display information words transmitted to each subscriber is three. However, there will be no problem if the number of display digits is smaller or larger, or even if there is only a calling signal word but no display information word.

In FIG. 2, a calling number of the paging receiver to be called is entered through a pushbutton telephone set 101. A conventional telephone exchange network 102 transfers the calling number in the form of a multi-frequency (MF) signal to a paging terminal 100. An MF receiver 104 receives the transferred MF signal through a trunk circuit 103 and detects the calling number, which is supplied to a register 105 is applied. The calling number in the register 105 through an input/output port 107 and is checked against subscriber data file stored in a random access memory (RAM) 111. This checking is accomplished under control of a central processing unit (CPU) 114 which operates according to the instructions stored in a read-only memory (ROM) 112. If it is registered in the subscriber data file, the CPU 114 actuates a tone generating circuit 106 through the port 107 to send a valid tone to a subscriber line.

Upon receipt of this valid tone, the subscriber enters a first asterisk (*), message codes to be sent, and a second asterisk in sequence through a use of the push button telephone set 101. Thus the input might, for instance be, "*123458*".

A pushbutton tone receiver 108 in the terminal 100 receives the signal and decodes it into a BCD code, which is then fed to a register 109. Upon detection of the second asterisk, the register 109 ceases to receive codes and gives an output signal indicating this cessation. The output signal is sent through the input/output port 107 to a central controller 110 composed, for example, of a type 8080 controller marketed by Intel Co. In response to this code, the central controller 110 first enters the calling signal code into the register 105 via the input/output port 107. This signal is encoded into a BCH code by adding the word discriminating bit of "0" to the calling signal code as shown in FIG. 1B. The resulting code is stored in the RAM 111. Then the message codes are entered from the register 109. After it is marked off at every fifth digit (each comprising four bits) and the word discriminating bit of "1" is added to the message code, it is entered into an address following the calling signal code in the RAM 111.

Thus, the codes successively entered in this manner are stored in the calling signal code area of the RAM 111. A timer 126, gives an output timing, and feeds its output to the input/output port 107 for example, every other minute (or 60 seconds). Upon detection of this timing output, the central controller 110 supplies, through an input/output port 113, in sequence, the calling signal code and message code in the calling signal code area of the RAM 111, following a preamble signal code stored in the ROM 112 as shown in FIGS. 1A, 1B and 4A. A level converting circuit 124 converts the level of these codes into a level suitable for use by a modulator 115, which sends out this code, as an FSK signal suitable for transmission over line 118. The FSK signal is demodulated into a baseband signal code by a demodulator 116 in a transmitting base station, and fed to a transmitter 117, which modulates a radio carrier wave with this baseband signal code and then sends it out as an electromagnetic wave through an antenna 119.

The operation in a paging receiver of FIG. 3 will now be described hereunder by referring to FIGS. 4A to 4D.

When switch 14 is closed, power is supplied from a battery 15 to a (programable) read-only memory (ROM) 4, an alert tone generator 8 and a decoder section 6. The intermittent power from a timing circuit 2 is supplied to a radio section 1. A radio carrier wave modulated with the aforementioned codes, is demodulated into the baseband after being received and amplified by the radio section 1. A timing circuit 2 detects a preamble signal and a sync signal shown in FIG. 1A, to activate the various circuit therein and to establish word synchronization, respectively.

Figure 4B:
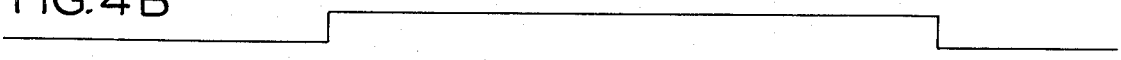

A calling signal detecting circuit 3 compares a calling signal code set in the ROM 4 and an input signal code. If the difference between the calling signal code in the ROM is no more than one bit, the ROM circuit gives an output B, whose time chart is shown in FIG. 4B. A display signal processing circuit 5 is actuated by the output B of the calling signal detecting circuit 3.

Figure 4C:
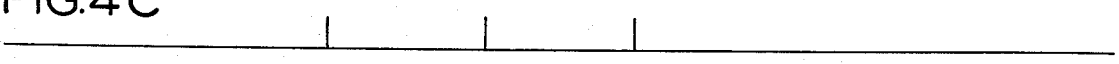
Figure 4D:
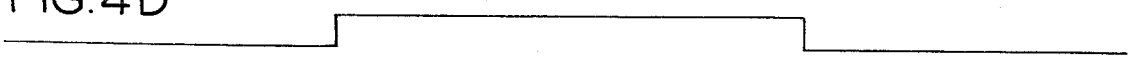

A flipflop 11 stores the word discriminating bit 23 shown in FIG. 4A in response to a timing pulse shown in FIG. 4C, from the timing circuit 2. The waveform of the output D of the flipflop 11 is illustrated in FIG. 4D. The AND circuits 12 and 13 are for error correcting when the display signal processing circuit 5 detects an error in the word discriminating bit. In the event of such an error, the display signal processing circuit 5 supplies a pulse to the preset or clear terminal of the flipflop 11 through AND gate 12 or 13, to correct the output of the flipflop 11 from "1" to "0" or vice versa.

The display signal processing circuit 5, when it is activated by the output of the calling signal detecting circuit 3, judges a change in output of the flipflop 11 to "0" to indicate completion of the reception of display information. Then, circuit 5 actuates the alert tone generating circuit 8 to give an alert tone to a speaker 9. At the same time, circuit 5 optically gives display information on a conventional display unit 10 (comprising a driver and a liquid crystal assembly, for example). Meanwhile, the display signal processing circuit 5 resets the calling signal decoding circuit 3 to return it to standby preparatory for reception of the next signal. In this manner a receiver receives display information when the word discriminating bit following the reception of its own calling signal is "1" and ceases to receive display information when the discriminating bit turns to "0".

Figure 3:
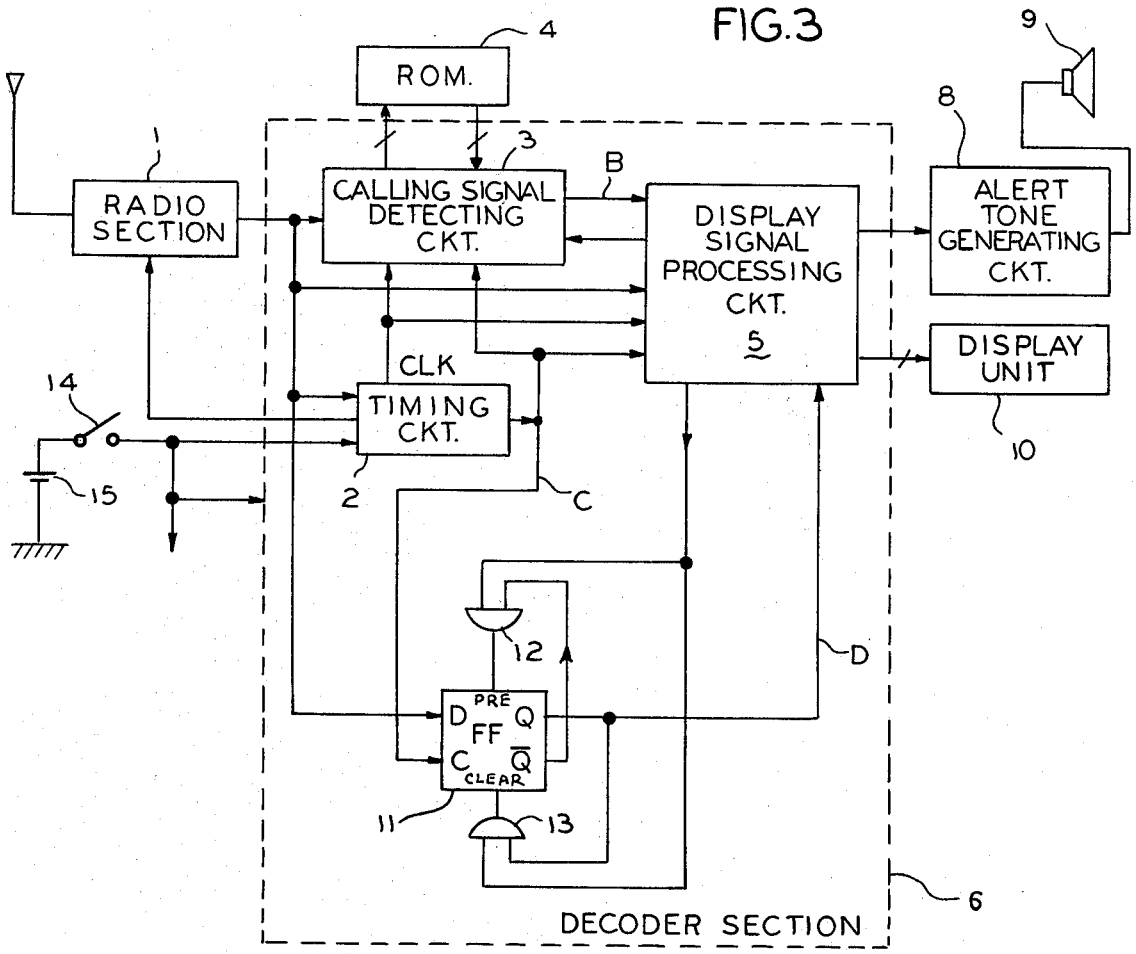
FIG. 3 is a block diagram of a receiver of the present invention.

In the timing circuit 2, an oscillator 204 (FIG. 5A) generates a battery saving pulse for intermittently supplying the output power of the battery 15 through the power switch 14 to the radio section 1 (FIG. 3). The output of the battery saving circuit 204 drives a power switching element 210 (FIG. 5A) by way of an OR gate 209. A battery 15 is connected to this switching element 210 by way of a power switch 14 (FIG. 3), and power is fed to the radio section 1 via the power switching element 210. The radio section 1 is periodically actuated, and operates for a fixed duration each time that it is on. When the radio section 1 is active and receives the modulated carrier wave, a demodulated output is supplied from the radio section 1 to the timing circuit 2.

A calling signal, as illustrated in FIG. 1A is preceded by a preamble signal, which consists of repetition of a "1010" pattern and is sent out for a period with a longer duration than the cycle of the battery saving pulse. Upon receipt of this preamble signal, a clock regenerating circuit 201 (FIG. 5A) regenerates a clock pulse signal which is supplied to the calling signal detecting circuit 3, the display signal processing circuit 5, a counter 205, timers 206, 213 and 207, a preamble signal detecting circuit 202 and a sync signal detecting circuit 203. The preamble signal detecting circuit 202, upon receipt of eight bits of this 1010 pattern, actuates the timer 206.

The preamble signal detecting circuit 202 may include a circuit similar to the sync signal detecting circuit 203 described to hereunder. Upon detection of a preamble signal, a flipflop 208 is set to maintain power supply to the radio section 1 responsive to a signal at its output Q delivered, by way of the OR gate 209 and the switching element 210. In response to a detection pulse of the preamble signal, the sync signal detecting circuit 203 is also actuated.

Figure 5A:
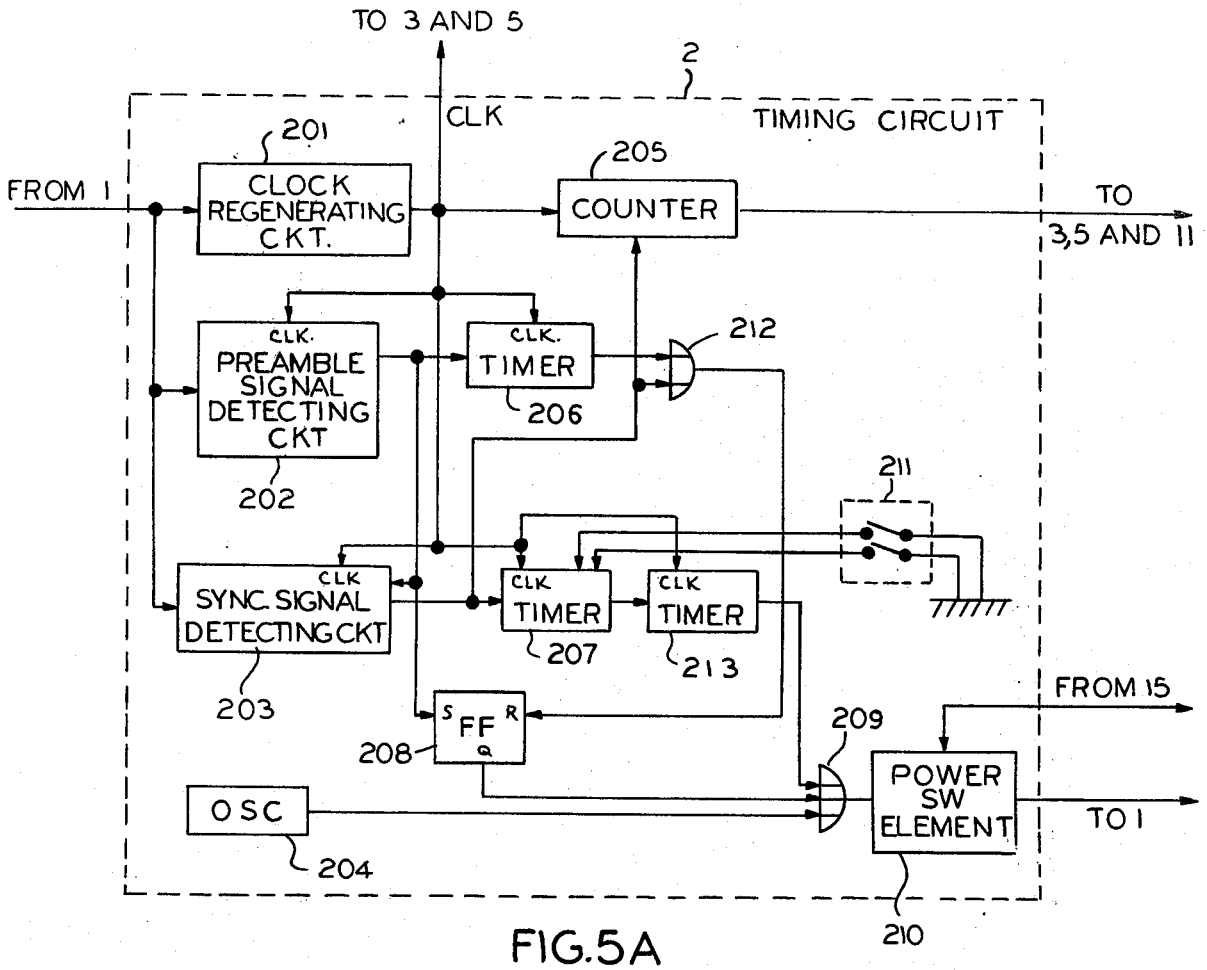
FIG. 5A is an example showing a detailed block of the timing circuit of FIG. 3.
Figure 5B:
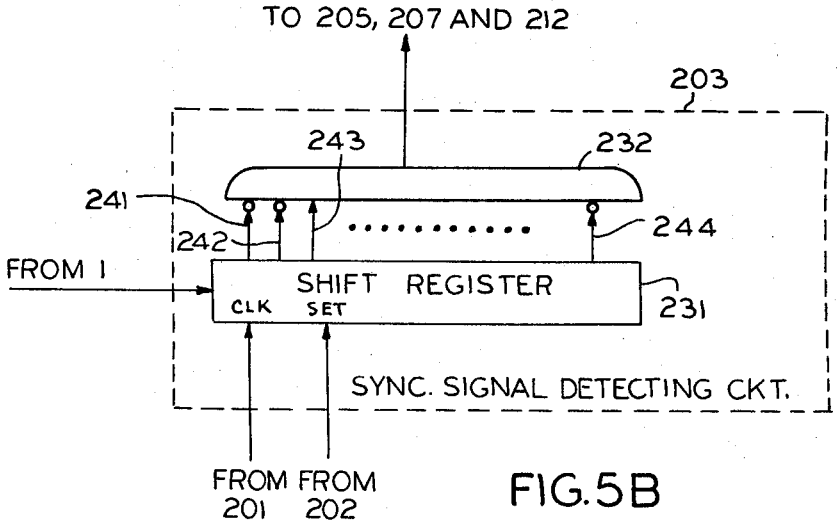
FIG. 5B is an example showing the detailed circuit of a sync signal detecting circuit shown in FIG. 5A.

As illustrated in FIG. 5B, the sync signal detecting circuit 203 comprises a shift register 231 and a checking circuit 232. The shift register 231 enters an output from the radio section 1 (FIG. 3) in response to the clock from the clock regenerating circuit 201 (FIG. 5A) and is set by the output from the sync signal detecting circuit 203. The checking circuit 232 detects whether the outputs 241 to 244 of the shift register 231 are identical with a preset sync signal code. If a sync signal 27 (FIG. 1A) is detected, the output of the checking circuit 232 resets a flipflop 208 through an OR gate 212, and the timer 207 is actuated. The timer 207 provides a timing $T_2$ (FIG. 1C) which is set by a group setting element 211, in response to the output of the sync signal detecting circuit 203. A timer 213 activates the power switch element 210 via the OR gate 209 in response to the output the timer 207, to supply the output power of the battery 15 to the radio section 1 during a predetermined time period $T_3$ (FIG. 1C). The timer 206 resets the flipflop 208 via the OR gate 212 when no sync signal is detected in a predetermined time period $T_1$ after detection of a preamble signal, to intermittently activate the power switch element 210 in response to the aforementioned battery saving pulse. Upon detection of a sync signal, a counter 205 is started, which gives the signal C representing the first bit of the word of the flipflop 11 (FIG. 3), the calling signal detecting circuit 3 and the display signal processing circuit 5 at every 31-bit clock position.

Figures 6, 9:
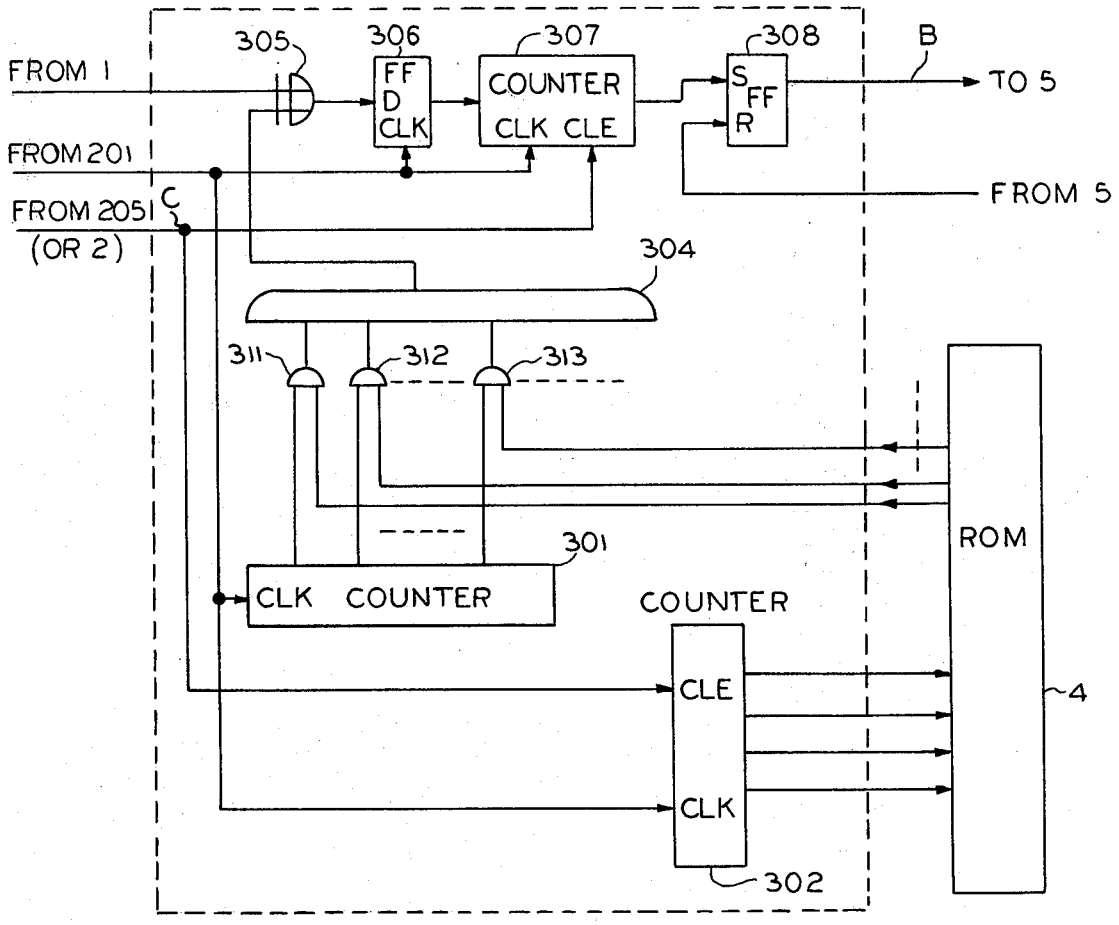
FIG. 6 is an example showing a composition of the calling signal detecting circuit of FIG. 3.
FIG. 9 is an example showing a parity check matrix.

In the calling signal detecting circuit 3 shown in FIG. 6, a counter 302 operates in synchronism with word timing from the timing circuit 2 (FIG. 3) in order to designate for the ROM 4, the address to be read out. A counter 301 (FIG. 3) to serially converts the contents of the address read out, gives a scan signal in bits to AND gates 311 to 313 in response to the clock signals and the word timing. An AND gate 304, responds to a signal from the AND gates 311 to 313 to give the calling signal codes of its own receiver stored in the ROM 4 to an Exclusive OR circuit 305 which, responsive to comparing a demodulated output entered from the radio section 1 (FIG. 3) with the data in the ROM 4, a "0" is given if they are identical or "1" if not. A flipflop 306 (FIG. 6) reads in the output of the Exclusive OR circuit 305 at the clock timing supplied from the clock regenerating circuit 201 (FIG. 5A). A counter 307 counts the "1" outputs of this flipflop 306 under control of the clock and the word timing, i.e. how many of the input signals are different from the codes in the ROM 4. If the number of differences is either 0 or 1 within a word, a flipflop 308 is set. The output of the flipflop 308 is fed to the display signal processing circuit 5 (for example, a type 8048 display marketed by the Intel Co.) 5.

Figure 7:
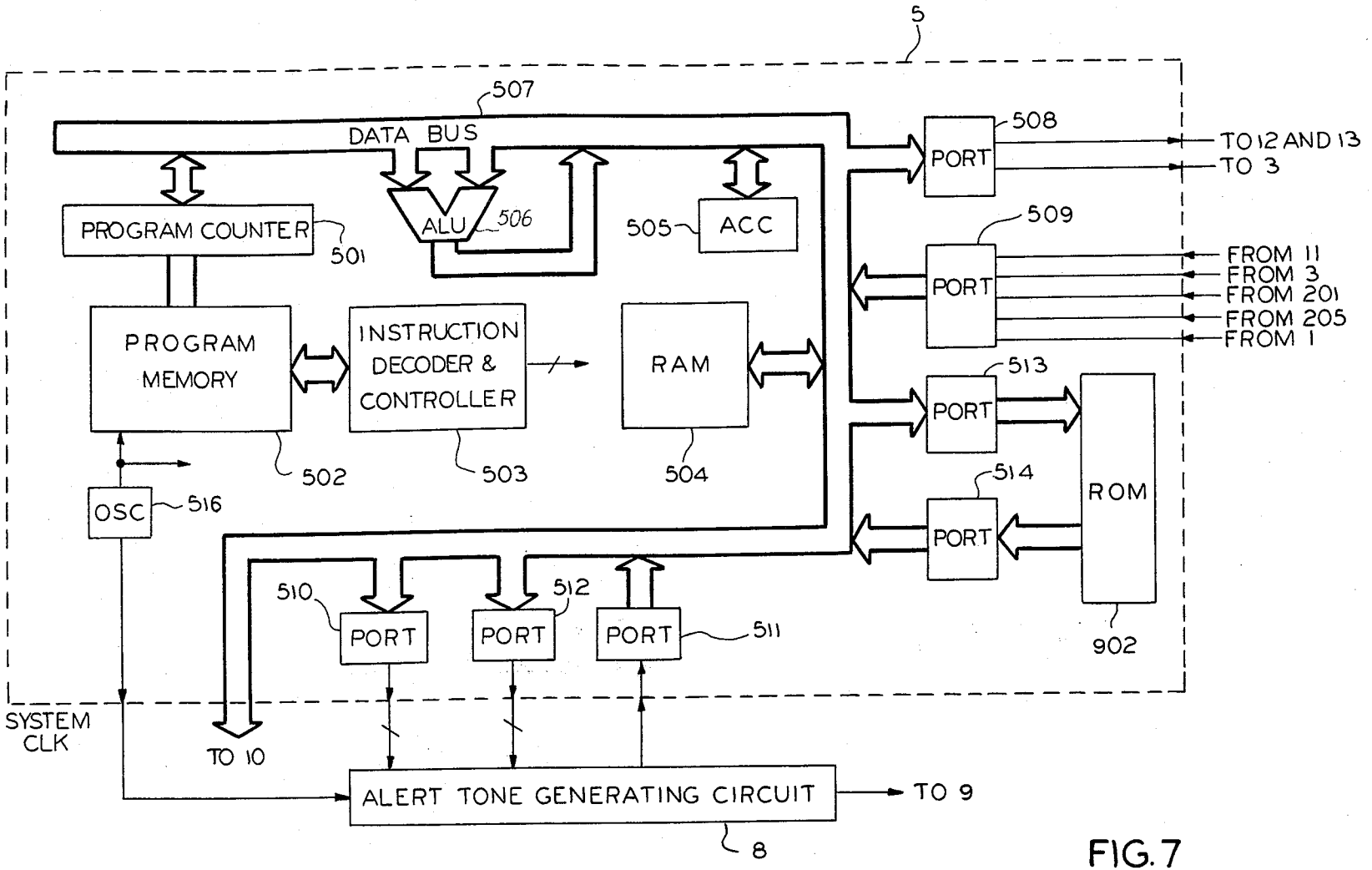
FIG. 7 is one example showing the display signal processing circuit of FIG. 3.

The display signal processing circuit 5 shown in FIG. 7 stores a sequence of instructions which are to be executed with storage being in a program memory 502. The contents of the address designated by a program counter 501 are conveyed to an instruction decoder and controller 503, which decodes the information so conveyed and gives control signals, corresponding to the instruction, to various parts.

The contents of the program counter 501 usually has a "1" added after information is conveyed from the program memory 502 to the instruction decoder and controller 503. These contents are altered at a branch instruction, jump instruction or the like, and such instructions are successively executed. An ALU 506 achieves various operations including arithmetic and logical operations. A random access memory (RAM) 504 is used to permit the content of program counter and the program status to stand by either while the processed data are stored or during interruption by a subroutine. An ACC 505 is used for storing the operational results of the ALU 506 and for exchanging data between the RAM 504 and ports 508 to 514.

A data bus 507 is a signal line for exchanging data among different parts of the system. The ports 508, 510, 512 and 513 are output ports for giving signals on the data bus 507 to external circuits. These ports have a latching function. The ports 509, 511 and 514 are input ports for enabling the data bus 307 to receive signals from external circuits in the decoder section 6. An oscillator 516 generates a stream system clock pulses for the display signal processing circuit 5.

Figure 8:
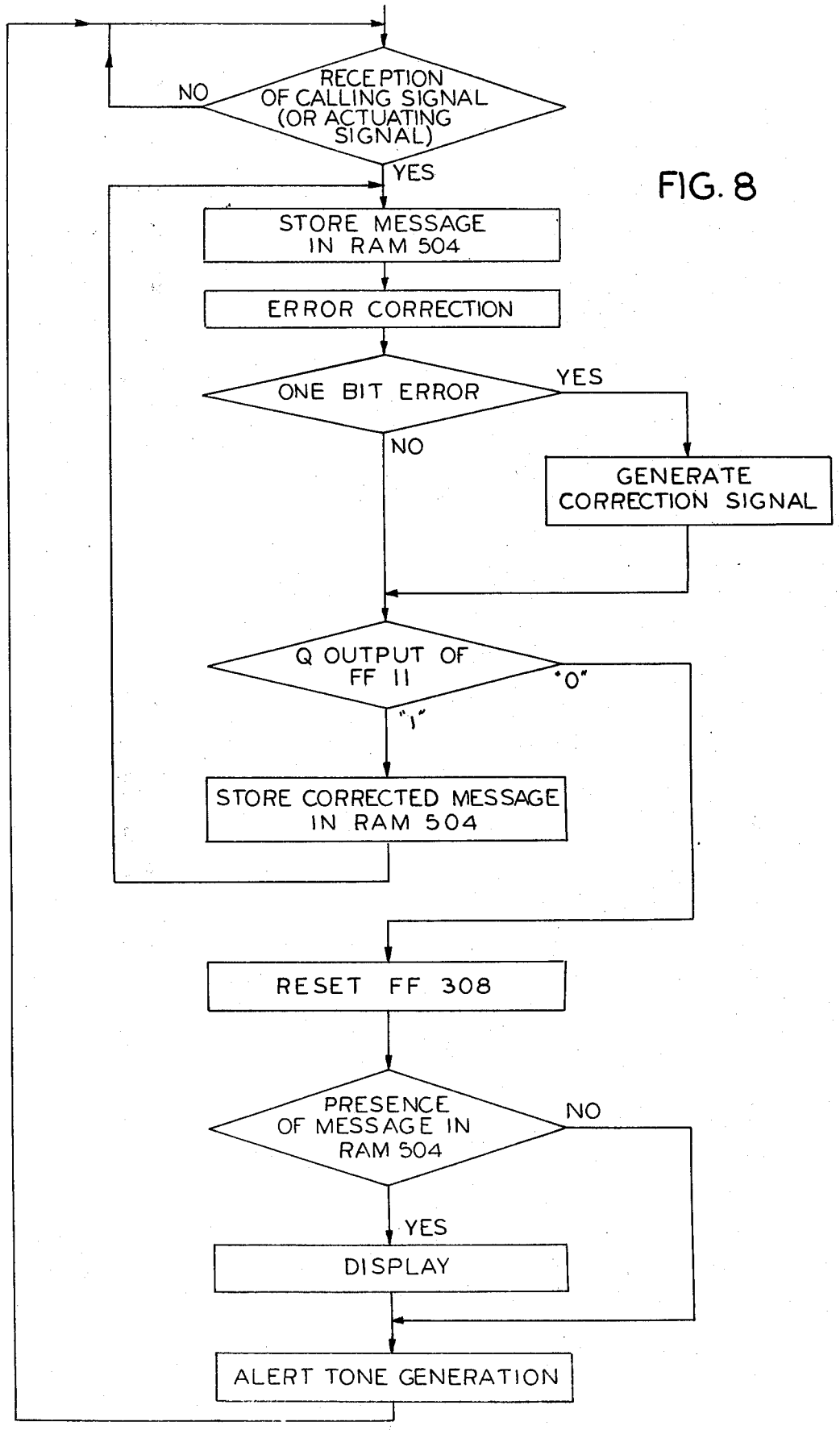
FIG. 8 is an operation flow chart of the display signal processing circuit.

FIG. 8 is a flow chart of the operation of the display signal processing circuit 5. The calling signal detecting circuit 3 (FIG. 3) receives a calling signal and gives an actuating signal B (FIG. 3) to the display signal processing circuit 5 through the port 509 (FIG. 7). The display signal processing circuit 5 starts operating and stores in the RAM 504 a demodulated output from the radio section 1 by way of the port 509. Upon entering each word, the processing circuit 5 corrects any error in the word.

The program memory 502 contains a stored parity check matrix shown in FIG. 9. The input data are represented by $I = a_1 a_2 a_3 \ldots a_{31}$, where $a_1$, standing for each bit of data, is either "1" or "0". These data are subjected to a matrix operation with the parity check matrix. A particular bit or $a_n$ and each corresponding bit element of $C_n$ are subjected to an AND operation, which results are modulo 2-added for each element. Thus, the resultant matrix S is represented by the following formula as a syndrome matrix.

$$S = a_1C_1 \oplus a_2C_2 \oplus \ldots a_{31}$$

If the syndrome matrix S is 0, there will be no error in its data. If S is not 0, the parity check matrix C and syndrome matrix S are checked with each other. If $C_n = S$, the corresponding data $a_n$ is erroneous and accordingly is corrected to "0" if it is "1" or to "1" if it is "0". The absence of $C_n$ corresponding to S indicates the presence of an incorrectable error in the data. Error correction is achieved by this procedure, which is a logical operation and therefore can be programmatically accomplished. The principle of error correction in this manner is disclosed in the paper entitled "An Introduction to Error Correcting Codes", by Shu Lin Prentice-Hall Inc., pp 12 to 57, 1970.

If the first bit is found erroneous as a result of such checking, an error correcting signal is supplied through the port 508 to the AND gates 12 and 13 (FIG. 3). If the output from the flipflop 11 (FIG. 3) to the port 509 is "1", the error-corrected message is stored in the RAM 504, followed by the entry of the next data. If the signal from the flipflop 11 is "0", a reset signal is supplied from the port 508 (FIG. 7) to reset the FF 308 (FIG. 6) in the calling signal detecting circuit 3.

If any message signal is present in the RAM 504 at this point of time, its contents are transferred to the display unit 10 (FIG. 3). The alert tone generating circuit 8 generates various alert tones corresponding to the first digit of the message code. If no message is present therein, no such displaying is conducted and the alert tone generating circuit 8 is activated. The presence of an incorrectable error, as referred to above, is indicated by alternately turning on and off the digit corresponding to this message.

Figure 10:
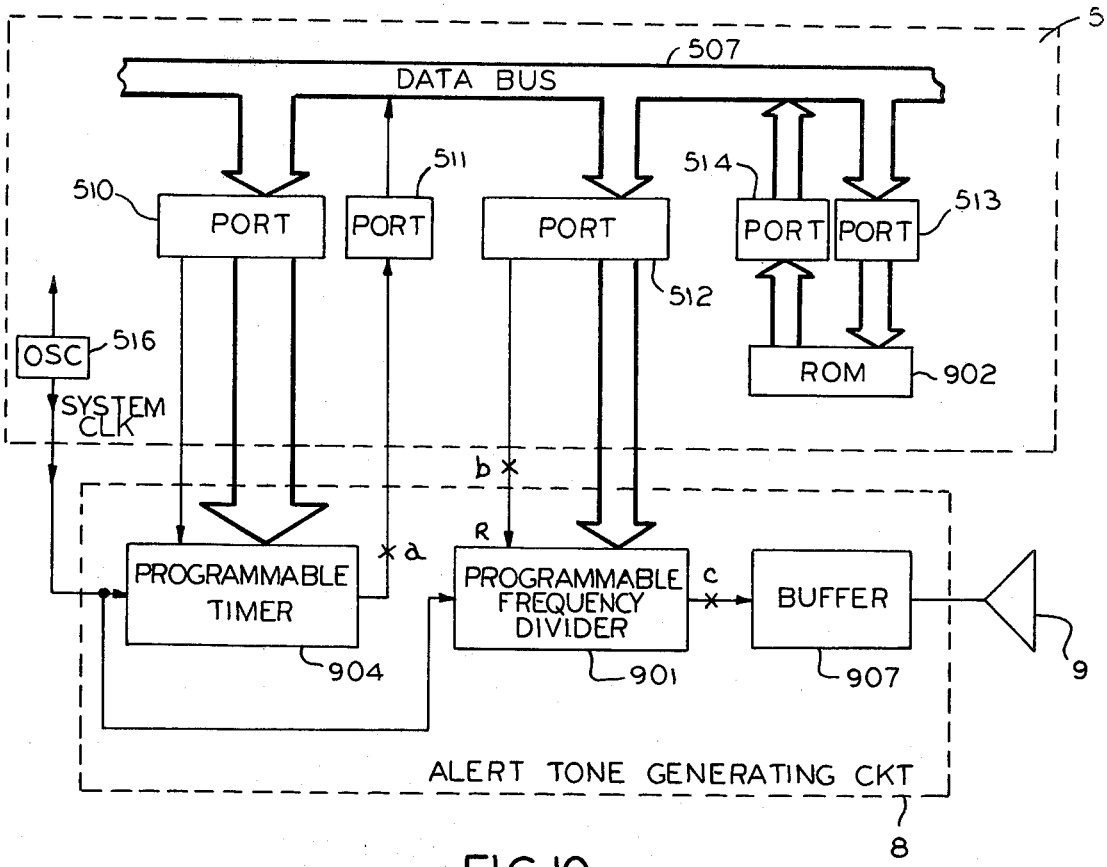
FIG. 10 is an example showing the alert tone generating circuit.
Figure 11:
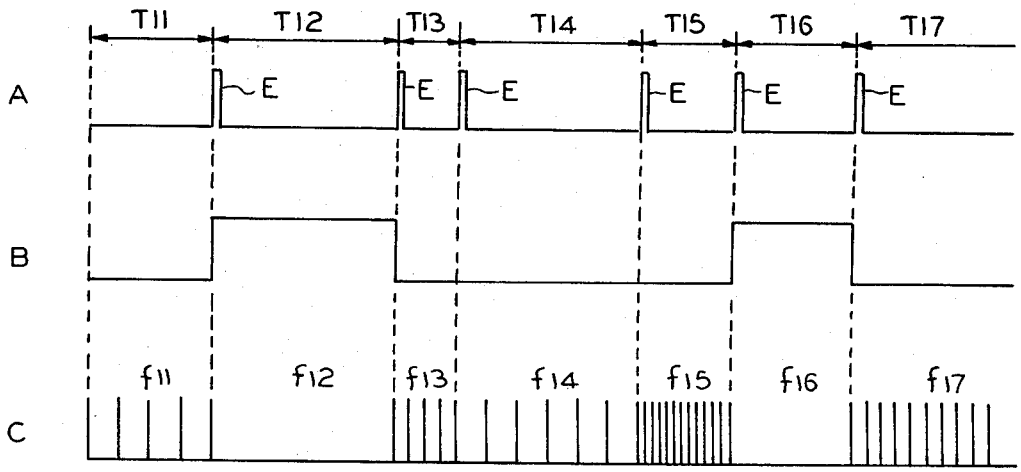
FIG. 11 is a time chart illustrating the operation of the alert tone generating circuit of FIG. 10.

The alert tone generating circuit 8 shown in FIG. 10 will now be described by referring to FIGS. 11A through 11C, which show the waveforms at points a through c, respectively, in FIG. 10. The circuit comprises a programmable frequency divider 901, a programmable timer 904 and a buffer 907, thereby generating tones of different pitches and rhythms corresponding to the first digit of the message code, which are thereby distinguished from one another. A ROM 902 (FIGS. 7 and 10) stores the data $X_i$ and $Y_i$ ($i = 11, 12, \ldots$) corresponding to time $T_i$ (FIG. 11) in the timer 904 and a frequency dividing ratio in the divider 901, respectively. The system clock pulses are supplied from the oscillator 516 to the timer 904 and the divider 901.

During time Ti, the divider 901 is set with the data $Y_i$ read out from the ROM 902 through the ports 514 and 512. The timer 904 is reset by the reset signal supplied through the port 510 and set by the data $X_i$ read out from the ROM 902 and supplied through the ports 514 and 510. The port 512 is also connected to a reset terminal of the divider 901. The divider 901 provides the divided frequency $f_i$ corresponding to the data $Y_i$ at the point c shown in FIG. 11C when the level at the point b is low (for example, when $T_i$ is $T_{11}$, $T_{13}$, $T_{14}$, $T_{15}$ or $T_{17}$). On the other hand, divider 901 provides a low level output at the point c by resetting the divider when the level at the point b is high (for example, when Ti is $T_{12}$ or $T_{16}$). After the laspe of time $T_i$, the timer 904 provides an end signal E as shown in FIG. 11A and sends it to the port 511 of the display processing circuit 5. The circuit 5 performs the processing operation of $T_i+1$ in response to the end signal. Thus, the alert tone generating circuit 8 provides tones of different frequencies and rhythms as shown in FIG. 11C and sends them to the speaker 9 via the buffer 907.

As heretofore described, the present invention enables a number of display information words to be transmitted as desired, and makes it possible to provide a receiver which is flexibly responsive to information quantity. For instance, one word may use information of up to five decimal digits and two words for sending information up to 12 decimal digits. Therefore, the transmitted information can therefore efficiently utilize the communication channel. A receiver of the invention can also provide an alert tone by changing the frequency and intermittence mode of the alert tone.

What is claimed is:

1. A paging communication receiver comprising first means for receiving a carrier wave modulated with a sequence of signals comprising a calling signal, a display information signal, and a discriminating signal immediately preceding each of said calling signal and display information signal; second means for demodulating the modulated carrier wave into said sequence of signals; third means for detecting said sequence of signals as said calling signal to provide a detection signal, when said discriminating signal identifies said calling signal; fourth means responsive to said detection signal for decoding said sequence of signals as said display information signal to provide a decoded signal, when said discriminating signal identifies said display information signal; and fifth means for displaying said decoded signal.

2. The receiver of claim 1 further comprising means responsive to said discriminating signal for separating said calling and display information signals.

3. The receiver of claim 1 or claim 2 wherein said receiver is one of a plurality of receivers used in a paging system, and said third means comprises means in each receiver for storing a signal which identifies that receiver, and means for comparing said stored signal with said calling signal in order to provide said detection signal.

4. The receiver of claim 3 and means for intermittently powering at least part of said receiver during stand-by periods for conserving energy of said power means.

5. The receiver of claim 3 and means for sounding an alert signal responsive to said comparing means providing said detection signal.

6. The receiver of claim 5 and means for sounding an alert signal in the form of a predetermined melody.

7. The receiver of claim 3 and means for checking the parity of signals demodulated from said carrier wave.

8. A method of paging a selected one from among a plurality of subscribers in a radio paging system comprising the steps of:

(a) detecting a broadcast carrier wave modulated by a plurality of binary encoded word signals of indeterminant length, each of said word signals being separated from other word signals by a plurality of discriminatory signals;

(b) demodulating said carrier wave to recover said encoded word signals;

(c) separating said encoded word signals into calling signals and display information signals in response to said discriminatory signal, whereby said system is adapted to use said indeterminant length word signals;

(d) detecting one of said separated calling signals; and (e) displaying at least one of the separated display information signals and sounding an alarm at said particular receiver in response to a detected call for that receiver.

9. The method of claim 8 and the added step of intermittently powering equipment when said particular receiver is waiting for said broadcast carrier wave.

* * * * *